United States Patent [19]

Kogler

[11] 4,389,075

[45] Jun. 21, 1983

[54] DEVICE FOR PREVENTING INGRESS OF DUST THROUGH THE ANNULAR GAP BETWEEN THE CUTTING ARM AND THE CUTTING HEAD OF A CUTTING MACHINE

[75] Inventor: Peter Kogler, Knittelfeld, Austria

[73] Assignee: Voest-Alpine Aktiengesellschaft, Vienna, Austria

[21] Appl. No.: 213,500

[22] Filed: Dec. 5, 1980

[30] Foreign Application Priority Data

Jan. 23, 1980 [AT] Austria ..... 360/80

[51] Int. Cl.³ ..... E21C 35/22

[52] U.S. Cl. ..... 299/81; 299/89; 277/24; 277/135; 277/DIG. 1

[58] Field of Search ..... 299/81, 89; 277/24, 277/135, DIG. 1; 175/339, 340

[56] References Cited

U.S. PATENT DOCUMENTS

| | | | |
|---|---|---|---|
| 3,236,530 | 2/1966 | Zagorski | 277/135 X |
| 3,698,769 | 10/1972 | Amoroso | 299/81 |
| 4,123,069 | 10/1978 | Sato | 277/DIG. 1 |
| 4,183,417 | 1/1980 | Levefelt | 175/339 |

*Primary Examiner*—Ernest R. Purser

*Attorney, Agent, or Firm*—Cushman, Darby & Cushman

[57] ABSTRACT

For the purpose of sealing the annular gap between a cutting arm (2) and cutting heads (6) rotatably supported on this cutting arm (2), a main sealing (12) and an additional sealing element (13) is provided. The area of the annular gap (17) is rinsed by water flowing from the gap in outward direction, the water supply conduit (18) opening into the outward area, being designed as a labyrinth, of the gap (7) via a nozzle (17) (FIG. 3).

7 Claims, 3 Drawing Figures

Figure 1:
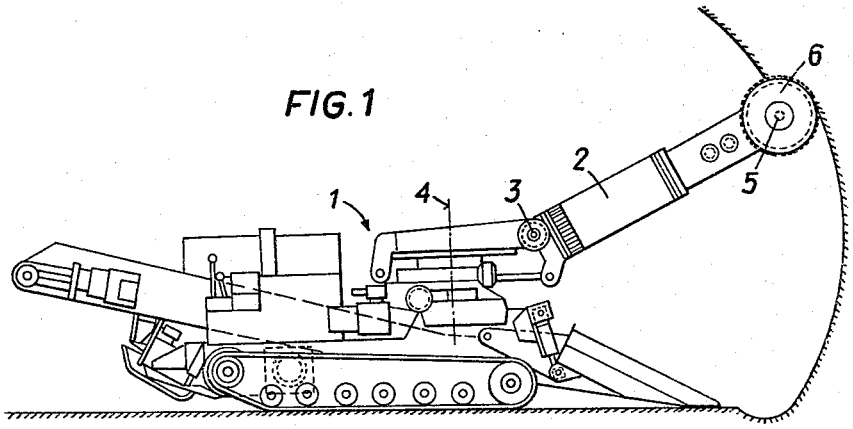

DEVICE FOR PREVENTING INGRESS OF DUST THROUGH THE ANNULAR GAP BETWEEN THE CUTTING ARM AND THE CUTTING HEAD OF A CUTTING MACHINE

The present invention refers to a device for preventing ingress of dust through the annular gap between the cutting arm and the cutting head of a cutting machine into the interior space of the hollow cutting head, within which is housed the last reduction gear stage of the cutting gear, said interior space being sealed against the annular gap by a main sealing and an additional sealing element being arranged within the annular gap outside of the main sealing. In an arrangement in which the last reduction gear stage of the cutting gear is housed within the hollow cutting head, the annular gap between the cutting arm and the cutting head has a great length. With a diameter of 1 m, the length of this annular gap is already 3 m. A great amount of dust is formed during cutting operation. In an arrangement, in which the last reduction gear stage is housed within the hollow cutting head, the space accommodating this reduction gear stage is filled with oil and ingress of dust into this oil-filled space results in a severe wear of the gearing. The interior space of the cutting head is closed relative to the cutting arm by means of a main sealing. It has already been proposed to rinse with grease the annular gap extending from the exterior side to the main sealing, but the result was not satisfying in view of the great length of the circumference of this annular gap.

In such an arrangement there existed also the danger that grease enters the interior space of the cutting head through the main sealing and impairs the quality of the oil bath within this interior space so that the lubrication of the gears of the last reduction gear stage becomes impaired.

It is an object of the present invention to prevent the ingress of dust to the main sealing and the invention essentially consists in that a water supply conduit is opening outside of the additional sealing element into the annular gap being open in outward direction. The water can now be used in amounts sufficient for rinsing an annular gap of such great diameter and ingress of dust into this annular gap is prevented from the very beginning and, resp. dust having already penetrated the annular gap is conveyed in outward direction. The water emerging in a corresponding great amount from the annular gap is disturbing the excavating operation at a lower degree than a great amount of emerging oil, irrespective of the fact that the use such great amounts of oil would be uneconomical.

According to the invention, the exit opening of the water supply conduit is preferably provided on the cutting arm because supply of water to the cutting arm is more simple than water supply to the cutting head. According to the invention, the exit opening of the water supply conduit is conveniently formed of a nozzle forming a jet of axial or tangential direction so that the annular gap is rinsed clear under the effect of the water jet formed by the nozzle. When using one single nozzle, this nozzle covers on rotation of the cutting head the whole circumferential wall of the cutting head which delimits the annular gap. However, also a plurality of nozzles may be distributed over the circumference.

According to a preferred embodiment of the invention the arrangement is such that the additional sealing element is non-rotatably connected with the cutting head and is rotating with the cutting head and that the nozzle stationarily arranged on the cutting arm is directed against this sealing element. With this embodiment, the additional sealing element itself is rinsed clean and the water is then, starting from the sealing element, flowing out of the annular ring gap being open in outward direction over the whole circumference of this ring gap. Preferably, the additional sealing element has a U-shaped cross section and its lips directed in outward direction, said additional sealing element being for example formed of a retaining ring, the nozzle being directed against the annular groove between the lips of the sealing element having U-shaped cross section. The water is conveniently flowing out of the nozzle under a pressure of approximately 2 bar. A pressure of 2 bar can easily be maintained and is sufficient for rinsing clear the annular gap. Preferably, the annular gap opening in outward direction from the area of the nozzles and, respectively, of the additional sealing element is designed as a throttle gap. Thus, ingress of dust into the annular gap is, on the one hand, impeded and a sufficient flow velocity within the annular gap can, on the other hand, be maintained with an only low water consumption which is of advantage for dust removal.

The invention is further illustrated with reference to the drawing schematically showing an embodiment of the invention.

In the drawing

Figure 2:
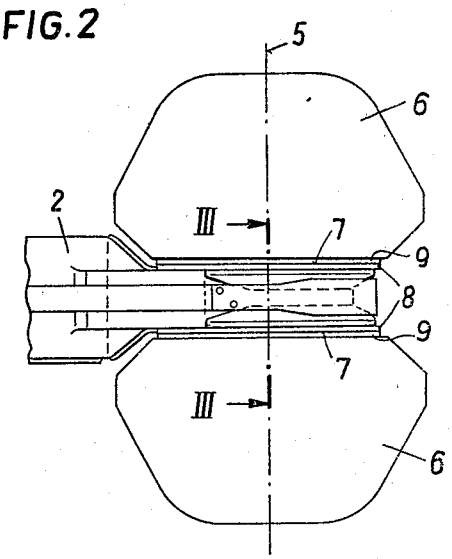
Figure 3:
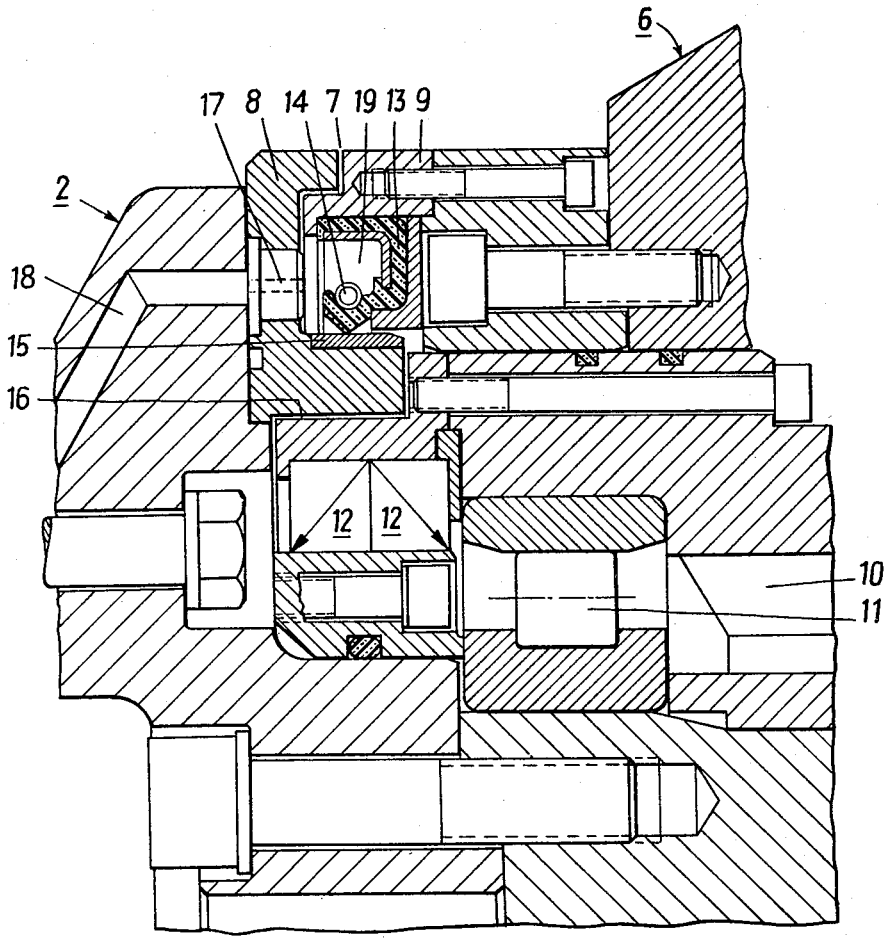

FIG. 1 shows a cutting machine together with its cutting arm and its cutting heads, FIG. 2 shows the front portion of the cutting arm with its cutting heads, and FIG. 3 shows a detail in a section along line III—III of FIG. 2.

A cutting arm 2 is carried by the cutting machine 1 and pivotable around a horizontal axis 3 and pivotable around a vertical axis 4. The cutting heads 6 are rotatably supported on the cutting arm 2 and are rotated around the axis 5. The cutting heads 6 are together with the front end of the cutting arm 2 shown in FIG. 2 in a top plan view. The cutting heads are hollow and within the interior space of the cutting heads there is housed the last reduction gear stage of the cutting gear. In view of the cutting heads being rotatably supported there exists, of course, a gap 7 between the cutting arm 2 and each cutting head 6 and in view of the cutting head housing the last reduction gear stage the circumference of this gap is comparatively great.

The mentioned gap 7 is shown in a larger scale in FIG. 3. A ring 8 is firmly screwed onto the front end of the cutting arm 2. A ring 9 is already forming part of the cutting head 6 which is rotatably supported on the cutting arm 2 and is rotatable relative to this cutting arm. 10 is a portion of the interior space of the cutting head which is housing the last reduction gear stage. 11 is a bearing for bearingly supporting the cutting head 6 on the cutting arm 2.

The interior space 10 is sealed against the gap portion 16 by means of a main sealing 12. 13 is an additional sealing element which is formed of a retaining ring. This is a lip seal of elastic material which is pressed by a worm spring 14 against a bearing ring 15 rigidly connected to the cutting arm. This additional sealing element 13 is tightly closing against the gap portion 16 the gap 7 opening in outward direction.

The additional sealing element 13 is fixed on the cutting head 6. On the cutting arm 2, a nozzle 17 is arranged which receives water under a pressure of approximately 2 bar via a conduit 18. This nozzle 17 is opening into the gap 7 at a position which is just opposing the additional sealing element 13. The water jet coming out from this nozzle 17 is directed in axial direction against the annular groove 19 of the additional sealing element 13. On rotation of the cutting head, this water jet coming from the nozzle 17 is thus impinging all, one after the other, areas of the additional sealing element 13. In this manner, the sealing element and thus also the whole gap 7 is rinsed clear. The gap 7 is designed as a throttle gap so that, on the one hand, the amount of water consumed is kept low and, on the other hand, a certain flow velocity is maintained within this gap. There can also be arranged along a circle several such water nozzles 17. The nozzles 17 can, as shown in the drawing, be arranged in axial direction but can also be arranged in an oblique position and be directed in tangential direction. If the nozzles are arranged in tangential direction it will be convenient to direct the water jets in opposition to the direction of rotation of the cutting head 6.

What is claimed is:

1. Device for preventing the ingress of dust through the annular gap between the cutting arm and the cutting head of a cutting machine into the interior space of the hollow cutting head within which is housed the last reduction gear stage of the cutting gear, said interior space being sealed against the annular gap by a main sealing and an additional sealing element being arranged within said annular gap outside of the main sealing, said additional sealing element being stationarily arranged on the cutting head and rotatable therewith, said device including at least one water supply conduit having a discharge nozzle carried by the cutting arm, said nozzle forming an axial or tangential jet directed against said additional sealing element.

2. Device as claimed in claim 1, characterized in that the additional sealing element has a U-shaped cross section having its lips forming the U-legs directed in outward direction, said sealing element, for example, being formed of a retaining ring, and in that the nozzle is directed against the groove or cavity between the U-legs.

3. Device as claimed in claim 1, characterized in that the water is flowing out of the nozzle under a pressure of approximately 2 bar.

4. Device as claimed in claim 1, characterized in that the annular gap extending from the nozzle in outward direction is designed as a throttle gap.

5. In a cutting machine: a cutting arm which carries a hollow rotatable cutting head spaced from the cutting arm by an annular gap which is open to the atmosphere around its circumference, said hollow cutting head having an interior space in which is housed the last reduction gear stage of a cutting gear system; a main annular seal in said gap and an additional annular seal in said gap at a location radially outward of the main seal, said additional seal being carried by and rotating with said cutting head; and at least one water supply conduit opening into said annular gap at a location such that water supplied into said gap flows out through the open circumference of said gap to thereby maintain said gap free of dust, the opening of said water supply conduit being a nozzle carried by said cutting arm and arranged to direct water against said additional seal in a generally axial direction with respect to the axis of rotation of said cutting head.

6. A cutting machine as in claim 5 wherein said water supply conduit is carried by said cutting arm.

7. A cutting machine as in claim 5 or 6 wherein the opening of said water supply conduit is a nozzle which forms a water jet in axial or tangential direction with respect to the axis of rotation of the cutting head.

* * * * *